United States Patent [19]

Krieger et al.

[11] Patent Number: 4,694,730

[45] Date of Patent: Sep. 22, 1987

[54] PROP CONTROL VALVE

[75] Inventors: Karl Krieger, Wuppertal; Werner Reinelt, Bochum, both of Fed. Rep. of Germany

[73] Assignee: Hermann Hemschedit Maschinenfabrik GmbH & Co., Wuppertal, Fed. Rep. of Germany

[21] Appl. No.: 920,926

[22] Filed: Oct. 16, 1986

Related U.S. Application Data

[63] Continuation of Ser. No. 765,232, Aug. 13, 1985, abandoned.

[30] Foreign Application Priority Data

Aug. 18, 1984 [DE] Fed. Rep. of Germany ..... 3430526

[51] Int. Cl.[4] ..... F01B 1/00

[52] U.S. Cl. ..... 91/170 MP; 251/63; 251/63.5

[58] Field of Search ..... 251/63, 63.5; 91/170 MP

[56] References Cited

U.S. PATENT DOCUMENTS

| | | | |
|---|---|---|---|
| 1,516,011 | 11/1924 | Heath | 251/63 X |
| 3,240,466 | 3/1966 | Meyer | 251/63 X |
| 4,040,600 | 8/1977 | Coppola | 251/63 |
| 4,267,861 | 5/1981 | Roth | 251/63 X |

*Primary Examiner*—Harold W. Weakley

*Attorney, Agent, or Firm*—Berman, Aisenberg & Platt

[57] ABSTRACT

The control valve for the re-setting of the props at a predetermined minimum setting pressure is connected at respective junctions to a high pressure conduit, to the pressure chambers of the props, to the prop-setting conduit and to the return-flow conduit leading to the annular chambers of the props. The spring-loaded closure body is guided displaceably in the valve housing by journals on each of the two sides of the valve cone. The ends of the journals are formed as actuation faces. The valve cone seals off the high pressure junction and the junctions leading to the pressure chambers of the prop and opens only when a predetermined minimum setting pressure at the junction is exceeded. For closure, the control valve is loaded through the junction on the actuation area of the journal with the pressure fluid conducted to the annular chambers of the props.

1 Claim, 1 Drawing Figure

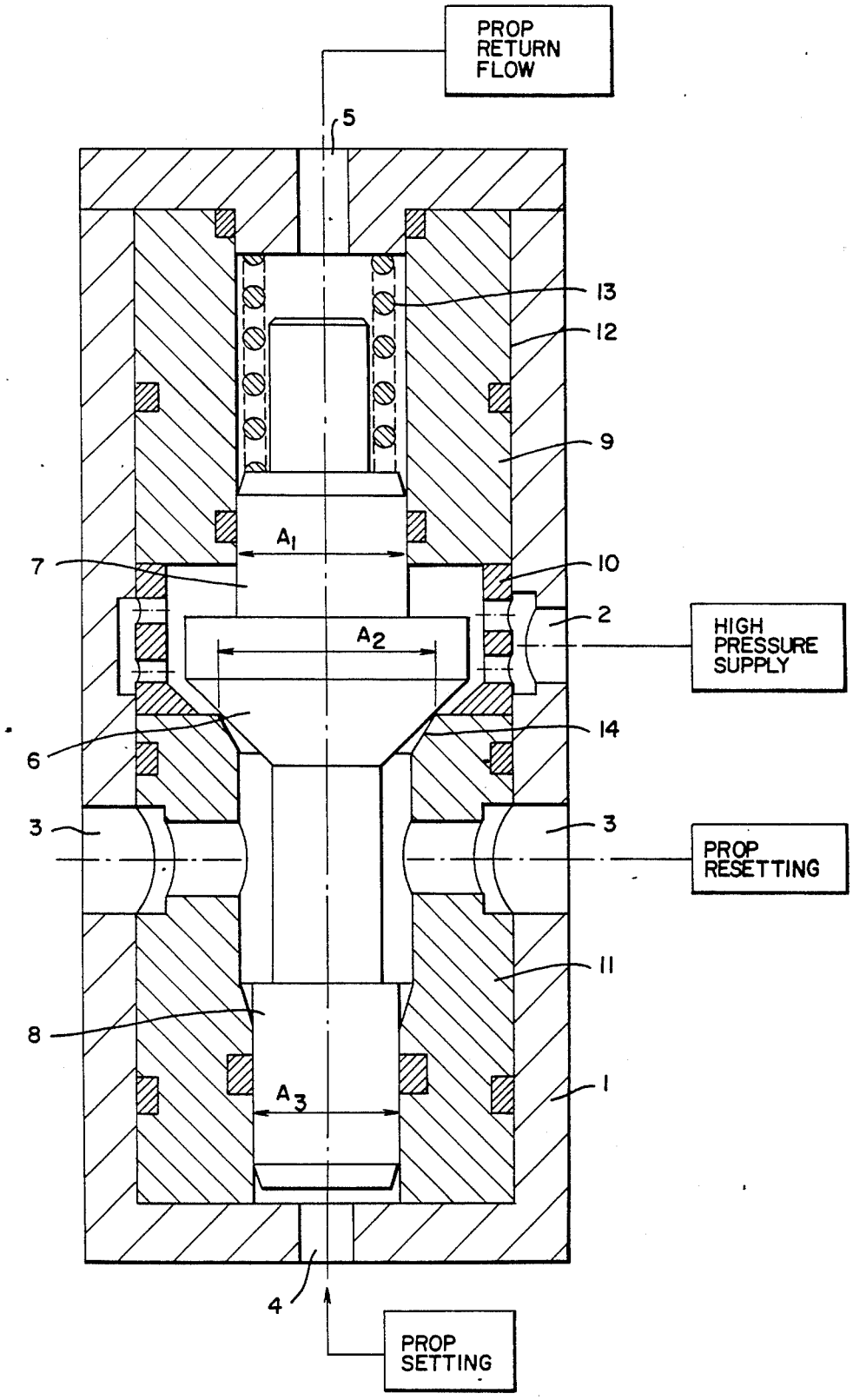
PROP RETURN FLOW
5
13
12
9
A1
7
10
2
HIGH PRESSURE SUPPLY
A2
14
6
3
3
PROP RESETTING
11
8
A3
1
4
PROP SETTING

PROP CONTROL VALVE

This is a continuation of U.S. application No. 765,232 which was filed on Aug. 13, 1985, and is now abandoned.

This invention relates to a control valve for the connection of the prop setting conduits associated with the pressure chambers of the hydraulic props of a walking mine roof support assembly to a supply conduit conducting high pressure, the valve comprising a cylindrical closure body having a sealing cone which, in the closed position, rests on a sealing seating under the action of the closure force of a closure spring and is guided displaceably in a housing of the valve, and a journal on each of the two sides of the sealing seating, the journals have actuation areas of different sizes which are loadable at their ends by a pressure medium for the actuation of the closure body in dependence upon a predetermined minimum setting pressure in the pressure chambers of the props.

Control apparatus for the re-setting of the props of an hydraulic walking mine roof support system is known from German Published Specification No. 2,749,312. The apparatus described therein comprises a pressure-controlled 3/2 directional control valve as a changeover valve and a 2/2 directional control valve as a subsequently-placed re-setting valve. The two directional control valves are each opened by an actuator piston against the closure force of a spring. The closure force of the spring pre-determines the minimum setting pressure at which the changeover valve opens, and pressure fluid flows from the high-pressure-conducting supply conduit to the actuator piston of the subsequently-placed re-setting valve. The opened re-setting valve connects the pressure chamber of the prop with the supply conduit.

The sealing cone or other sealing surface of the re-setting valve is brought back into the closure position by a second actuator piston having a larger piston area and working against a pressure-limiting valve so that the valve shuts off at a pre-determined prop pressure. The actuator piston, loaded with pressure fluid on both sides, can assume an undefined floating position before shutting off. The prop cannot be retracted if the valve is not shut off, because the large actuator piston is shifted without pressure during return-flow and the fluid present on the small piston remains enclosed by a non-return valve and the pressure-limiting valve.

The aim of the present invention is to produce control apparatus of simple and dimensionally small size which displays good actuation behaviour. With this aim in view, the invention is directed to a control valve as described in the opening paragraph of the Specification in which:

(a) the sealing area of the sealing surface cone of larger dimension than the actuation area on one spring-loaded journal which is larger than the actuation area on the other journal, which again is larger than the annular area formed between the sealing area of the sealing cone and the spring-loaded acutation area;

(b) the closure body is loadable on the actuation area with a minimum second pressure against the closure force of the closure spring and above the sealing cone with the pressure present on the annular area and is held in the open position by the pressure present on the annular area against the closure force of the closure spring; and (c) the closure body is loadable on the actuation area with the pressure supplied to the annular chambers of the props during retraction of the latter.

For the re-setting of the props in accordance with the present invention, only one control valve with a valve cone is required, and this is assembled from a few parts of simple production. The dimensions of the individual components of the control apparatus are adapted to one another in such a way that the sealing cone or other sealing surface is controlled in every control position by defined forces. The control valve is held in the closure position by the high pressure present in the pressure supply conduit as long as the pre-determined minimum setting pressure in the prop is not reached. If this limit value is exceeded in the setting of the props, the valve cone is held in the open position against the closure force of the closure spring by the pressure in the supply conduit. On return-flow taking place, the force acting in the closure direction in combination with the closure spring is greater than the counter-force acting in the opening direction.

An example of a control valve in accordance with the invention is shown in longitudinal section in the accompanying drawing.

The hydraulic props of a walking mine roof support assembly and the pressure conduits and control valves connected thereto for the charging of the props with pressure fluid from a supply conduit conducting high pressure P are not illustrated in the drawing as such support assemblies are well known in the art.

Five junctions 2 to 5 are arranged on the externally-closed and sealed valve housing 1 of the control valve. The junction 2 is provided for connection with the supply conduit conducting high pressure P, while 3 designates two junctions through which pressure fluid from the supply conduit is conducted to the pressure chambers of the props when the control valve is set into the open position in the re-setting operation. By means of junction 4, the control valve is connected to the regular prop-setting conduit leading to the pressure chambers of the props. The junction 5 connects the control valve return-flow with the conduits leading to the annular chambers of the props.

The control valve comprises a cylindrical closure body 6 to 8 with a valve cone 6 in the middle region of its length. On both sides of the valve cone 6 there are journals 7 and 8 with which the closure body is guided displaceably in inserts 9, 10 and 11 of bush form within a central longitudinal bore 12 of the valve housing 1. The journal 7 which faces the junction 5 for the return-flow conduits and the cross-sectional area of which is designated by $A_1$ is loaded by a closure spring 13 which presses the valve cone 6, in the closure position as illustrated, upon a sealing seating 14 arranged at the (upper) end of the insert 11 of bush form. The sealing area $A_2$ formed is larger than the area $A_1$ of the journal 7, which again is larger than the area $A_3$ of the journal 8 on the side facing the junction 4 for the prop-setting conduit. Both journals 7 and 8 are guided displaceably between seals (not designated) in the inserts 9 and 11 so that, with their cross-sectional areas $A_1$ and $A_3$, they form actuation areas. The actuation area $A_1$ is loadable, through the junction 5 by the return-flow conduit of the props, in the closure direction of the valve cone 6. By means of the actuation area $A_3$, the valve cone 6 is brought into the open position by pressure fluid which is supplied through the junction 4 from the prop-setting conduit.

The sealing area $A_2$ formed between the valve cone 6 and the sealing seating 14 is situated between the junction 2 of the supply conduit conducting high pressure P and the junctions 3 of the re-setting conduits for the props. When the control valve is without pressure, the valve cone 6 is held in the closed position by the closure force $F_F$ of the closure spring 13. If with the junctions 4 and 5 without pressure the control valve is loaded only through the junction 2 with high pressure P from the supply conduit, then the valve cone 6 is loaded in the closure direction by the closure force $F_F$ of the closure spring 13 and the high pressure P present on the annular surface $A_2$–$A_1$ formed between the sealing surface $A_2$ and the spring-loaded actuator surface $A_1$.

In the setting of the props, pressure fluid from the prop-setting conduit arrives at the junction 4 and loads the actuation area $A_3$ on the journal 8. As long as the setting pressure present on the actuation area $A_3$ does not exceed a predetermined minimum setting pressure $P_X$, the valve cone 6 remains in the closure position. The following equilibrium relationship is valid:

$$(A_2-A_1)\cdot P+F_F>A_3\cdot P_X$$

If, however, the pressure in the props rises so far that the equation $$A_3\cdot P_X>(A_2-A_1)\cdot P+F_F \quad .$$

is fulfilled, then the valve cone 6 lifts away from the valve seating 14 and the high pressure P present on the junction 2 passes by way of the junctions 3 to the props.

The dimensions of the cross-sectional areas $A_1$, $A_2$ and $A_3$ of the control valve according to the invention and the force $F_F$ of the closure spring 13 are adapted in relationship to one another in such a way that the valve cone 6 is held in the closure position by the applied high pressure P until a predetermined minimum setting pressure $P_X$ of for example 140 bars is reached.

When the valve is in the open position, this equation of equilibrium is valid:

$$(A_1-A_3)\cdot P>F_F$$

The high pressure present on the annular surface $A_1$–$A_3$ holds the valve cone 6 automatically in the open position against the spring force. From this relationship it further follows that the valve cone 6 drops back into the closure position automatically when the high pressure P in the supply conduit sinks so far that the closure force $F_F$ of the closure spring is greater than the force acting on the annular area $A_a$–$A_3$.

The pressure fluid supplied to the annular chambers during retraction of the props passes by way of the junction 5 to the actuation surface $A_1$ of the journal 7 and presses the valve cone 6 back into the closure position, because the force relationship has varied as follows:

$$A_1\cdot P+F_F>(A_1-A_3)\cdot P$$

In this way the control valve is always actuated and held in the respective actuation position reliably and precisely.

We claim:

1. In combination, a control valve and prop conduits associated with the pressure chambers of the hydraulic props of a walking mine roof support assembly comprising:

a generally cylindrical valve housing, an elongate valve closure body arranged for longitudinal movement in the valve housing, a valve cone on an intermediate portion of the valve closure body, an annular valve seating arranged in the valve housing to be sealingly engaged by the valve cone with the valve closure body extending through the valve seating, a high pressure supply connected to said housing to communicate with valve cone, a valve closure spring in the valve housing arranged to act on one end portion of the valve closure body to press the valve cone into the valve setting, a first journal portion on the valve closure body on that side of the valve cone nearer the spring forming a first piston, a first cylinder in the valve housing slidingly and sealingly receiving the first piston for longitudinal movement therein, said first cylinder and said first journal portion forming a first chamber connected to the return flow conduit of a mine-roof prop, a second journal portion of the valve closure body on the side of the valve cone remote from the spring forming a second piston, and a second cylinder in the valve housing slidingly and sealingly receiving the second piston for longitudinal movement therein, said second cylinder and second journal portion forming a second chamber connected to a prop-setting conduit, the pistons having actuation areas of different sizes which are loadable by a pressure medium for the actuation of the closure body in dependence upon a predetermined minimum setting pressure in the pressure chambers of the props, the seal between the valve cone and the valve seating providing a sealing area of larger dimension than the actuation area on the first piston, the actuation area of the second piston having a smaller dimension than an annular area formed by the sealing area of the sealing cone and than the actuation area of the first piston, and the valve closure body with the valve cone and two pistons thereon being of one-piece construction.

* * * * *